United States Patent [19]

Babish

[11] 4,120,576

[45] Oct. 17, 1978

[54] DRUM SUPPORT APPARATUS

[75] Inventor: Andrew N. Babish, Macedon, N.Y.

[73] Assignee: Xerox Corporation, Stamford, Conn.

[21] Appl. No.: 784,083

[22] Filed: Apr. 4, 1977

[51] Int. Cl.[2] ..... G03G 15/00

[52] U.S. Cl. ..... 355/3 DR; 29/123; 355/133

[58] Field of Search ..... 355/3 DR, 3 R, 133; 242/68.6; 29/117, 123; 101/407 R, 407 A

[56] References Cited

U.S. PATENT DOCUMENTS

| | | | |
|---|---|---|---|
| 2,638,722 | 5/1953 | Rimmel | 29/117 X |
| 3,062,095 | 11/1962 | Rutkus et al. | 355/3 DR X |
| 3,490,841 | 1/1970 | Cely et al. | 355/3 DR |
| 3,536,397 | 10/1970 | Van Wagner | 355/3 DR |
| 4,040,157 | 8/1977 | Shanly | 29/123 |

FOREIGN PATENT DOCUMENTS

| | | | |
|---|---|---|---|
| 2,021,409 | 11/1971 | Fed. Rep. of Germany | 355/3 DR |

*Primary Examiner*—Richard L. Moses
*Attorney, Agent, or Firm*—James J. Ralabate; Clarence A. Green; William A. Henry

[57] ABSTRACT

Drum support apparatus including outboard and inboard hubs having outer surfaces adapted for interface fitting with the inside surface of a drum. The hubs while being supported on a shaft that is cantilevered from a frame have recessed areas on central portions thereof to cooperate with locking tabs located on a tubular member loosely fitted on the shaft whereby rotation of the hubs by approximately 20° creates a semi-rigid assembly that is rigidly secured to the shaft by the tightening of a single nut at the center of the drum. An assembly of this type creates an equal distribution of force on the hubs, thus diminishing circular run-out of the drum.

10 Claims, 1 Drawing Figure

DRUM SUPPORT APPARATUS

BACKGROUND OF THE INVENTION

This invention relates to drum support apparatus and more particularly to supports for photosensitive drums that prevent drum run-out. In present reproduction machines, a problem has been encountered with photoreceptor drum radial run-out of up to 0.050 inches or more. The reason for such a deviation in tolerance lies with the drums and how they are handled in manufacturing and in the field. Hitting the rim of the drum deforms the counterbore, and an out-of-tolerance condition occurs when endbells bells that interference fit with the drum are reassembled in the drum. This is especially true of the inner endbell in and a number of reproduction machines which is concave by about 5 inches. A slight cock in its assembly throws its shaft support bearing off center considerably due to magnification of the error by the length of the concavity. Since in a number of reproduction machines the shaft that is journaled to the machine frame is cantilevered from the frame to support a photoconductor drum without an exterior support, more run-out is observed with the inboard side of the photoconductor drum than on the outboard side.

In some reproduction machines that employ photoconductor drums that have endbells bells secured thereto by means of a series of tie rods, a problem has been encountered with localized distribution of forces, i.e., the force exerted by the tie rods is directed primarily at the area in which the tie rod is located as opposed to a uniform distribution of force throughout the end bells.

A solution of the above-mentioned problem of drum radial run-out is required before improved reproduction machines can be marketed incorporating magnetic brush rolls in the development process instead of cascade development because reducing the radial drum run-out minimizes the effects of the drum tolerance on spacing between the drum and the magnetic rollers.

Accordingly, it is an object of the present invention to provide a drum support apparatus that substantially reduces drum run-out.

Another object of this invention is to minimize the effects of drum tolerances on the spacing between a drum and a magnetic brush.

The foregoing and other objects of the present invention are accomplished by including a recess on the connecting surface of a hub that mates with a tab located on a member fitted on a support shaft whereby twisting of the hub creates a semi-rigid body that is subsequently tightened by a nut secured to the shaft.

BRIEF DESCRIPTION OF THE DRAWINGS

For a better understanding of the invention as well as other objects and further features thereof reference is had to the following detailed description of the invention to be used in conjunction with the accompanying drawings, wherein.

DESCRIPTION OF THE PREFERRED EMBODIMENT

Figure 1:
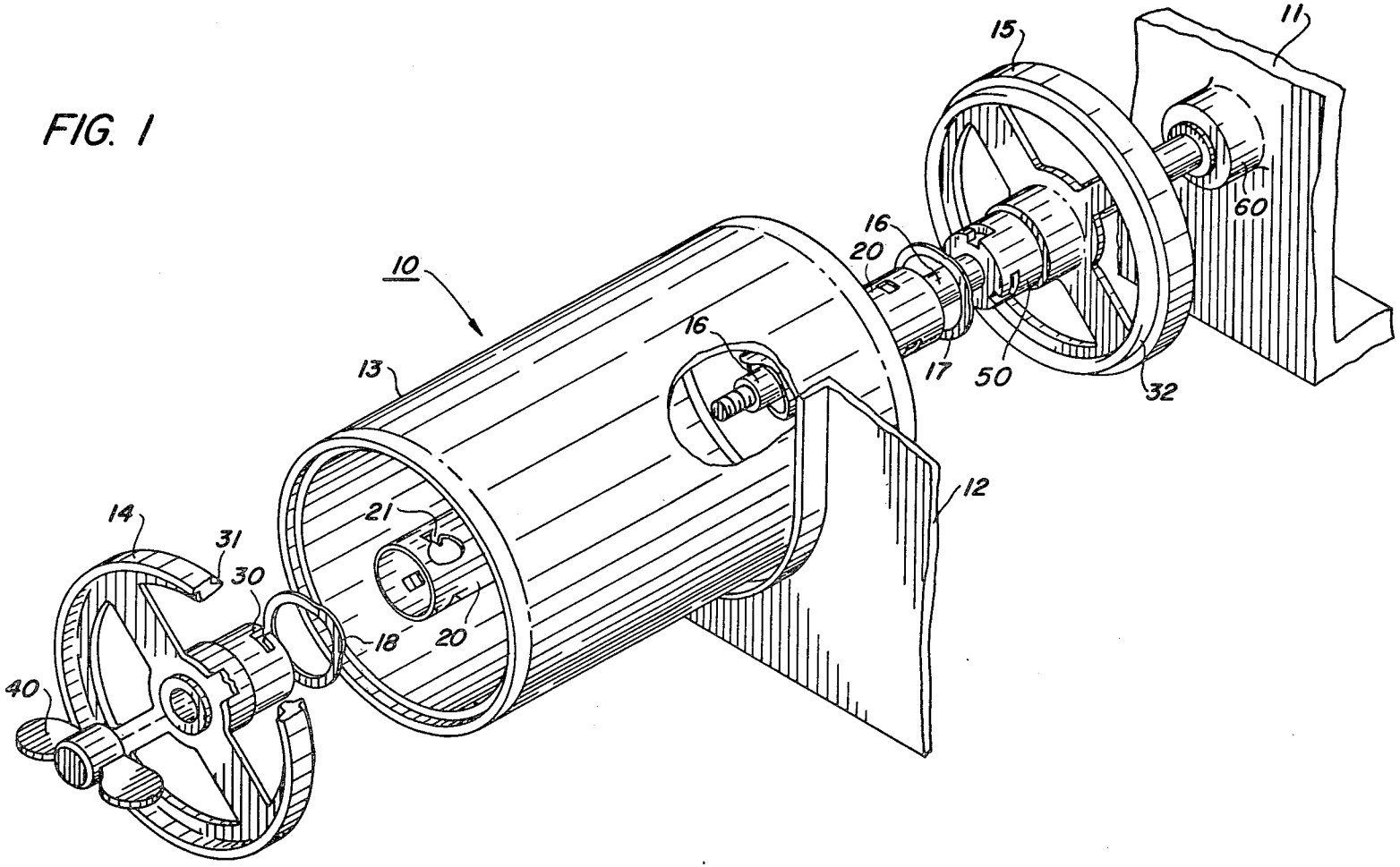
FIG. 1 is an exploded partial schematic of an apparatus incorporating the present invention.

The present invention can be used in any device that requires support for a drum. However, for the purpose of exemplary disclosure, the invention will be described within the environment of a xerographic reproduction apparatus. An example of such a xerographic reproduction apparatus is shown in U.S. Pat. No. 3,775,008 in the name of R. A. Schaeffer and is incorporated herein by reference. Examples of prior drum support members include U.S. Pat. Nos. 2,089,401; 3,536,485; 3,615,063; and 3,739,772. It is generally recognized that photoreceptor drum run-out is a significant contributor to field maintenance problems, and that is degrades copy quality.

The photoreceptor drum is the heart of a xerographic copier. As each copy is reproduced, a bar of light scans the original document, then transmits its reflected image through lenses to a revolving selenium coated drum which has been statically charged. Because of the conductivity of the drum, the light discharges the electrical charges, leaving a latent image identical to that on the document. The drum then rotates through a chamber of powdered ink which coats the charged areas. A sheet of paper is then precisely applied over the image. The image is then transferred electrically to the paper. After transfer the paper is stripped from the drum and passed through a fuser which fixes the image to the paper. To accomplish this, the drum must be (A) discharged, (B) cleaned, (C) charged (D) exposed, (E) developed, (F) covered with paper and (G) stripped of the paper and image for each copy made. To achieve and maintain reliably good copy quality, the radial dimensions and electrical tolerances in the cavity between the drum and the stations (A) through (G) must be rigidly maintained. Any out of roundness or imperfections in the drum surface may result in copy quality variations or possible drum damage, due to interference.

One of the most prevalent methods of bringing the powdered ink or development material into contact with an image bearing photoconductor is to pour or cascade developer material over the photoconductor, permitting the material to gravity flow downwardly in contact with the photoconductor for a sufficient period of time to effect development. With this method of development, it is satisfactory to support the photoconductive drum on a cantilever support. However, in order for xerographic machines to use magnetic brush development where the developer material is transported through a development zone adjacent the imaged photoconductor by the magnetic brushes, radial drum run-out and sometimes "walking" of the drum must be controlled because spacing between the drum and magnetic brush rollers must be maintained within allowable tolerances or degrading copy quality will result. In order to curtail the "walking" of the drum along the cantilevered shaft a two-pronged end support that is disclosed in U.S. Pat. No. 3,994,053 to William Hunt, issued Nov. 30, 1976, could be employed.

In reference to FIG. 1, the present invention is shown incorporated into a reproduction machine similar to the Xerox 4000. As is shown in the figure, a frame with a front panel 12 and a rear panel 11 for a reproduction machine is shown supporting a shaft 16 that is cantileverly mounted to the frame. Endbells or hubs 14 and 15 have concaved inner surfaces 31 and 32 that mate with the inner end surface of xerographic drum 13 and are shown being supported on the shaft with the inboard endbell 15 having a pronounced cavity 50 therein that fits over bearing 60 that is suitably connected to frame 11. A photosensitive member 13 is shown being placeable over the inboard endbell 15 and cavity 50 as well as being adaptable to be closed by outboard endbell 14. Shaft 16 has a tubular member 20 loosely fitted thereover that cooperates with the hubs 14 and 15 to maintain the drum 13 on the shaft. Endcap or third connection means 40 once screwed onto the shaft makes a rigid structure of the drum, endbells and shaft.

It is within the area of the endcap, endbells and tubular member that the present invention resides. The tubular member 20 in FIG. 1 can be fabricated from any suitable material but is shown, fabricated from steel sheet metal in tubular configuration with three lanced tabs spaced at about 120° apart at both ends. The tabs 21 or second connection means complement recessed areas or first connection means 30 in both endbells such that once an endbell is placed over the tubular member a slight twist in a predetermined direction will create a semi-rigid assembly. Wave washers 17 and 18 are shown for providing force between the tubular member 20 and the endbells 14 and 15. After a semi-rigid assembly has been made, endcap 40 is screwed onto shaft 16 at the center of the drum and creates an equal distribution of force on the endbells and thereby removing circular run-out of the drum.

As an alternative, the tubular member 20 could be fabricated as an aluminum extrusion having equally spaced ribs 120° apart integrally formed on the inside surface of the extrusion and substantially coextensive with the length thereof. The ends of the ribs are machined or otherwise suitably provided with tabs adapted to cooperate with recessed areas or endbells 14 and 15 to form a semi-rigid assembly upon manipulation of the endbells as described for FIG. 1. Wave washers could be used to provide force between the endbells and the tubular member.

In some reproduction machines, photoconductive drums have endbells that are secured to the drums by a number of tie-rods which create a problem with localized distribution of forces that tend to increase radial run-out of the drum. As can be seen from the above detailed description, the apparatus of the present invention creates a uniform distribution of force on the endbells by the tightening of a single nut in the center of the drum after a semi-rigid assembly has been accomplished by the twisting of endbell 14 counterclockwise and endbell 15 clockwise onto the ends of tubular member 20.

In addition to the apparatus outlined above, many other modifications and/or additions to the invention will be readily apparent to those skilled in the art upon reading this disclosure, and these are intended to be encompassed within the invention disclosed and claimed herein.

What is claimed is:

1. In a drum support apparatus including a shaft, a tubular member loosely fitted over said shaft, outboard and inboard hubs adapted to be releasably connected to said tubular member and said shaft for support of a drum thereon; the improvement comprising:

recessed means located on the area of the hubs that is adapted to releasably connect to said tubular member and said shaft;

tab means on said tubular member located such that rotation of said hubs approximately 20° engages said tabs with said recessed means; and fastening means for securing said hubs and said tubular member to said shaft and thereby creating an equal distribution of force on the hubs in order to diminish circular radial run-out of the drum.

2. The improvement of claim 1 wherein said fastening means is a nut.

3. The improvement of claim 2 wherein said shaft is cantilevered.

4. The improvement of claim 3 wherein said recessed means comprises a groove.

5. The improvement of claim 4 including force producing means located between said hubs and said tubular member.

6. The improvement of claim 5 wherein said force producing means is wave washers.

7. In a xerographic apparatus including a photosensitive drum and a frame within which the xerographic apparatus is mounted, a shaft mounted on said frame, a tubular member fitted over said shaft, at least one hub adapted to be releasably connected to said tubular member and said shaft for supporting said drum and seated against said drum; the improvement comprising:

first means located on a portion of said bub that is adapted to cooperate with a second means located on said tubular member, and wherein rotation of said first means by approximately 20° engages said first means with said second means; and securing means for establishing an equal distribution of force on said at least one hub in order to diminish circular drum run-out.

8. The improvement of claim 7 including force producing means located between the hub and said tubular member.

9. The improvement of claim 8 wherein said force producing means is a wave washer.

10. A method of reducing radial run-out of a photoreceptor drum in a xerographic machine that includes a shaft, 9 tubular member adapted to fit over said shaft, outboard and inboard hubs adapted to be releasably connected to said tubular member and said shaft for support of a photoreceptor, the steps comprising:

a. providing a first connection means on said outboard and endboard hubs adapted to releasably connect to said shaft;

b. providing second connection means on said tubular member;

c. providing a third connection means for securing said tubular member and hubs to said shaft;

d. connecting said first connection means of said outboard and inboard hubs to said second connection means by twisting said first connection means by about 20°; then e. securing said tubular member and hubs to said shaft with said third connection means to create an equal distribution of force on the hubs and thereby diminishing circular drum run-out.

* * * * *